US006745899B1

(12) United States Patent
Barton

(10) Patent No.: US 6,745,899 B1
(45) Date of Patent: Jun. 8, 2004

(54) WIRE PAYOUT

(75) Inventor: David J. Barton, Twinsburg, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 111 days.

(21) Appl. No.: 10/083,426

(22) Filed: Feb. 25, 2002

(51) Int. Cl.[7] ..... B65D 85/67; B65H 18/28; B65H 49/00

(52) U.S. Cl. ..... 206/409; 206/408; 242/171; 242/172; 242/129

(58) Field of Search ..... 206/409, 408, 206/397, 389, 413, 414, 817; 242/128, 129, 170, 171, 172, 615.2, 397.5, 593, 588.3, 137, 137.1, 138

(56) References Cited

U.S. PATENT DOCUMENTS

| | | | | |
|---|---|---|---|---|
| 4,869,367 | A | 9/1989 | Kawasaki et al. | |
| 5,277,314 | A | 1/1994 | Cooper et al. | |
| 5,494,160 | A | 2/1996 | Gelmetti | |
| 5,819,934 | A | 10/1998 | Cooper | |
| 5,845,862 | A | 12/1998 | Cipriani | |
| 2001/0006184 | A1 * | 7/2001 | Ohike et al. | 228/33 |

FOREIGN PATENT DOCUMENTS

| | | | | |
|---|---|---|---|---|
| EP | 1 057 751 | A1 | 12/2000 | |
| GB | 2332451 | A | 6/1999 | |
| JP | 58183570 | A * | 10/1983 | B65H/59/06 |
| JP | 62111872 | A * | 5/1987 | B65H/49/08 |
| WO | PCT/GB88/00488 | | 12/1988 | |
| WO | PCT/EP94/00493 | | 9/1994 | |

OTHER PUBLICATIONS

Welding Supplies (UK) Ltd. *Statement of Novelty,* 3 pages.
*WELD POINT Robotic Welding Wire, Technology of the Future* http://www.sidergas.com/ukprod.htm.
Prostar, *Premium Quality Twist–Free Robotic Welding Wire.*

* cited by examiner

*Primary Examiner*—Mickey Yu
*Assistant Examiner*—John G. Pickett
(74) *Attorney, Agent, or Firm*—Fay, Sharpe, Fagan, Minnich & McKee

(57) ABSTRACT

A payout for controlling the unwinding of a coil of wire from a wire drum which has an outer drum body and an inner core substantially coaxial with the drum body includes a first planar ring juxtaposed to the top of the wire coil and having a first inner edge closely adjacent to the core and a first outer edge spaced from the first inner edge and a second planar ring juxtaposed the top of the wire coil and having a second outer surface closely adjacent the drum body and a second inner surface spaced from the first outer surface of the first ring to define a continuous circular gap above the wire coil such that the wire passes upwardly through the gap as it is withdrawn from the wire coil. A third ring overlies the first and second rings and is laterally displacable relative thereto and eccentrically relative to the drum axis to further control payout of the wire. The second and third rings alone can be used to control payout of the wire.

31 Claims, 7 Drawing Sheets

WIRE PAYOUT

This invention relates to the art of dispensing wire and, more particularly to a wire payout for controlling the dispensing of large quantities of a continuous wire without tangling.

INCORPORATION BY REFERENCE

The present invention relates to feeding large quantities of a continuous wire from a container to a welding operation wherein the wire must be fed without tangling or interruption. Such containers are known in the art and are generally shown and described in Cooper U.S. Pat. No. 5,277,314; Cooper U.S. Pat. No. 5,819,934; Chung U.S. Pat. No. 5,746,380; Kawasaki U.S. Pat. No. 4,869,367 and Gelmetti U.S. Pat. No. 5,494,160. These patents are incorporated by reference herein as background information illustrating packaging and dispensing large quantities of wire. Further, these patents illustrate the importance of controlling the wire as it is being dispensed from the package to prevent tangling.

Seufer U.S. Pat. No. 5,816,466 illustrates the interaction between the wire package and the wire feeder which is a part of the welding apparatus and is incorporated by reference herein as background information.

BACKGROUND OF THE INVENTION

The present invention is particularly applicable for use in connection with welding wire and, therefore, the invention will be described with particular reference to a payout or retainer ring used with a package containing a large quantity of welding wire stored therein as a coil containing many convolutions formed into layers. However, the invention has broader applications and may be used with any type of wire or other wire-like materials.

It is, of course, well known that welding is an effective method of joining metal components. Further, it is well known that utilizing a welding wire as a consumable electrode in the welding process enhances the weld. Accordingly, it is desirous to package welding wire so that it can be cost effectively utilized. Furthermore, welding applications wherein large quantities of welding wire are consumed necessitate welding wire packages which contain large quantities of a continuous welding wire. Accordingly, large welding wire packages have been created for these applications which allow for a significant amount of welding run time before the operation must be shut down to restring a new package of welding wire. This is particularly important for automated or semi-automated welding operations.

In order to work in connection with the wire feeder of the welder, the welding wire must be dispensed in a non-twisted, non-distorted and non-canted condition which produces a more uniform weld without human attention. It is well known that wire has a tendency to seek a predetermined natural condition which can adversely affect the welding process. Accordingly the wire must be sufficiently controlled by the interaction between the welding wire package and the wire feeder. To help in this respect, the manufacturers of welding wire produce a wire having natural cast wherein if a segment of the wire was laid on the floor, the natural shape of the wire would be essentially a straight line; however, in order to package large quantities of the wire, the wire is coiled into the package which can produce a significant amount of wire distortion and tangling as the wire is dispensed from the package. As a result, it is important to control the payout of the wire from the package in order to reduce twisting, tangling or canting of the welding wire.

This condition is worsened with larger welding wire packages which are favored in automated or semi-automated welding.

The payout portion of the welding wire package helps control the outflow of the welding wire from the package without introducing additional distortions in the welding wire to ensure the desired continuous smooth flow of welding wire. Both tangling or breaking of the welding wire can cause significant down time while the damaged wire is removed and the wire is re-fed into the wire feeder. In this respect, when the welding wire is payed out of the welding wire package, it is important that the memory or natural cast of the wire be controlled so that the wire does not tangle. The welding wire package comprises a coil of wire having many layers of wire convolutions laid from the bottom to the top of the package. These convolutions include an inner diameter and an outer diameter wherein the inner diameter is substantially smaller than the width or outer diameter of the welding wire package. The memory or natural cast of the wire causes a constant force in the convolutions of wire which is directed outwardly such that the diameter of the convolutions is under the influence of force to widen. The walls of the welding wire package prevent such widening. However, when the welding wire pays out of the package, the walls of the package loose their influence on the wire and the wire is forced toward its natural cast. This causes the portion of the wire which is being withdrawn from the package to loosen and tend to spring back into the package thereby interfering and possibly becoming tangled with other convolutions of wire. In addition to the natural cast, the wire can have a certain amount of twist which causes the convolutions of welding wire in the coil to spring upwardly.

There are two aspects of controlling the unwinding of wire from a wire coil package. First is to prevent the upward springing of the wire convolutions within the wire coil package. The second is management of the wire as it travels from the wire coil package to the wire feeder so that it doesn't spring back. Controlling the upward springing effect of the wire convolutions is achieved by maintaining the position of the wire convolutions at the top of the wire coil and especially at a point where the upward springing effect is at its greatest which is towards the radially outer portions of the package. With respect to controlling the wire as it travels between the payout and the wire feeder, it has been found that tensioning along with guiding the wire can reduce the twisting and tangling effects. In this respect, by creating a slight tension along with using a guiding mechanism, the wire is controlled as it moves between the wire coil package and the wire feeder and is prevented from springing back into the package.

Payout devices or retainer rings have been utilized to control the spring back and upward springing of the wire and to control the payout of the wire. This is accomplished by positioning the payout or retainer ring on the top of the coil and forcing it downwardly against the natural springing effect of the welding wire. The downward force is either the result of the weight of the retainer ring or a separate force producing member such as an elastic band connected between the retainer ring and the bottom of the package. Further, the optimal downward force during the shipment of the package is typically different than the optimal downward force for the payout of the welding wire. Accordingly, while elastic bands or other straps are utilized to maintain the position of the payout or retainer ring during shipping, the weight of the retainer ring is often used to maintain the position of the payout relative to the wire coil during the payout of the wire.

The outward flow of wire, or payout, is managed by the payout or retainer ring's position on the top of the wire coil which holds the upper layers of the convolutions in place as the wire is withdrawn one convolution at a time. In addition, the payout or retainer ring includes an edge or surface, typically a radially inwardly facing edge or surface, which controls the payout of the wire. In this respect, the wire is pulled from the center of a ring shaped device and engages the radially inwardly facing portion thereof. The retainer ring further includes a mechanism to prevent the wire from springing around the radially outer side of the retainer ring. Prior art retainer rings utilize a unified ring structure which includes resilient members that tightly engage the inner surface of the outer package to protect the outer convolutions of the welding wire coil and prevent the wire from springing around the outside of the retainer ring.

SUMMARY OF THE INVENTION

In accordance with the present invention, provided is a payout for use in connection with a welding wire package which includes at least two separate and independent retaining rings of a light weight disposable material which cooperably control the payout of the welding wire. In this respect, a payout in accordance with the present invention includes at least one ring which rests on top of the coil of wire and which prevents the coil of wire from springing upwardly, and a second ring which at least partially rests on the one ring and which is spaced above the top of the coil of wire. The two rings, one of which may be a floating ring, cooperatively control the payout of the wire from the wire coil. By utilizing at least two rings, one of which may move independently of the other, simple ring structures can be used to optimize restraint of the wire from springing upwardly and to improve control of the payout of the wire from the wire coil.

A payout according to one aspect of the present invention can utilize both a radially inner and a radially outer stationary ring, which rings engage the top of the coil of wire and are radially spaced from one another to produce a circumferentially continuous wire payout gap therebetween which preferably is radially centrally of the inner and outer sides of the coil wire. In another embodiment, a floating ring is of the size and shape to partially cover the gap between the inner and outer rings. The wire, as it is payed out of the wire coil package, passes between one of the edges of the inner or outer rings and one of the edges of the floating ring which rotates about the coil axis and eccentrically relative thereto during payout. As a result, as stated above, simple payout or ring designs which are easy to manufacture can be used, and the individual rings can be designed for its specific purpose. This can include different material choices and different textures used along the guiding edges or other surfaces without requiring complex components or materials.

In accordance with another aspect of the invention the payout has only an outer stationary ring with a floating ring overlying the latter and surrounding the inner core of the welding wire package. In this embodiment, the wire is payed out between the inner edge of the outer ring and the inner core of the welding wire package and the inner edge of the floating ring controls the payout of the wire. In yet another embodiment, the gap between radially inner and outer rings is covered by the bristles of a brush ring secured to one or the other of the inner and outer rings, whereby payout of the wire is controlled by the resistance of the bristles.

The primary object of the present invention is the provision of a payout for a wire coil package which allows the continuous and uninterrupted withdrawal of a welding wire from the package smoothly and without tangling.

Another object is the provision of a payout of the foregoing character that utilizes non-intricate components which complement one another to achieve the desired continuous and uninterrupted withdrawal of the welding wire.

Still another object is the provision of a payout of the foregoing character which is light weight and disposable.

A further object is the provision of a payout of the foregoing character wherein the wire is withdrawn from the package along a circumferential path which is radially central with respect to the coil of wire.

Yet a further object is the provision of a payout of the foregoing character that utilizes at least one ring which rests on the top of the wire coil and a floating ring which rests on the top of the one ring wherein the one ring and either a second ring or a core component are spaced from one another forming a continuous gap therebetween and the floating ring partially covers the gap progressively about the axis of the coil during payout with the welding wire passing through the gap.

Another object is the provision of a welding wire package of the foregoing character which utilizes components that are economical to manufacture, easy to use in the field and which are economically disposable.

BRIEF DESCRIPTION OF THE DRAWINGS

The foregoing objects, and others, will in part be obvious and in part be pointed out more fully hereinafter in connection with a written description of preferred embodiments of the present invention illustrated in the accompanying drawings in which.

DESCRIPTION OF PREFERRED EMBODIMENTS

Figure 1:
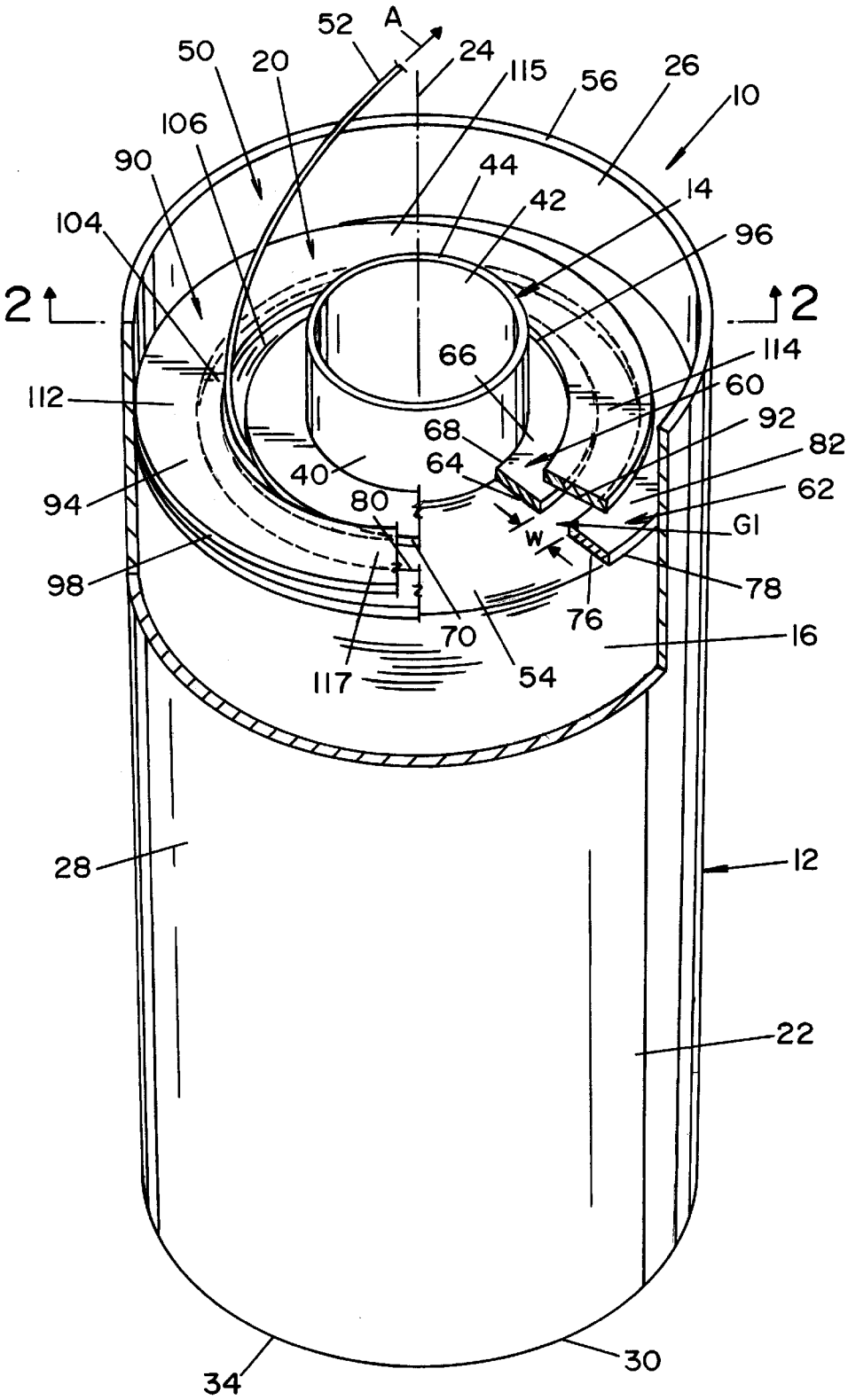
FIG. 1 is a partially sectioned perspective view of a welding wire package including welding wire and a payout in accordance with the present invention.
Figure 2:
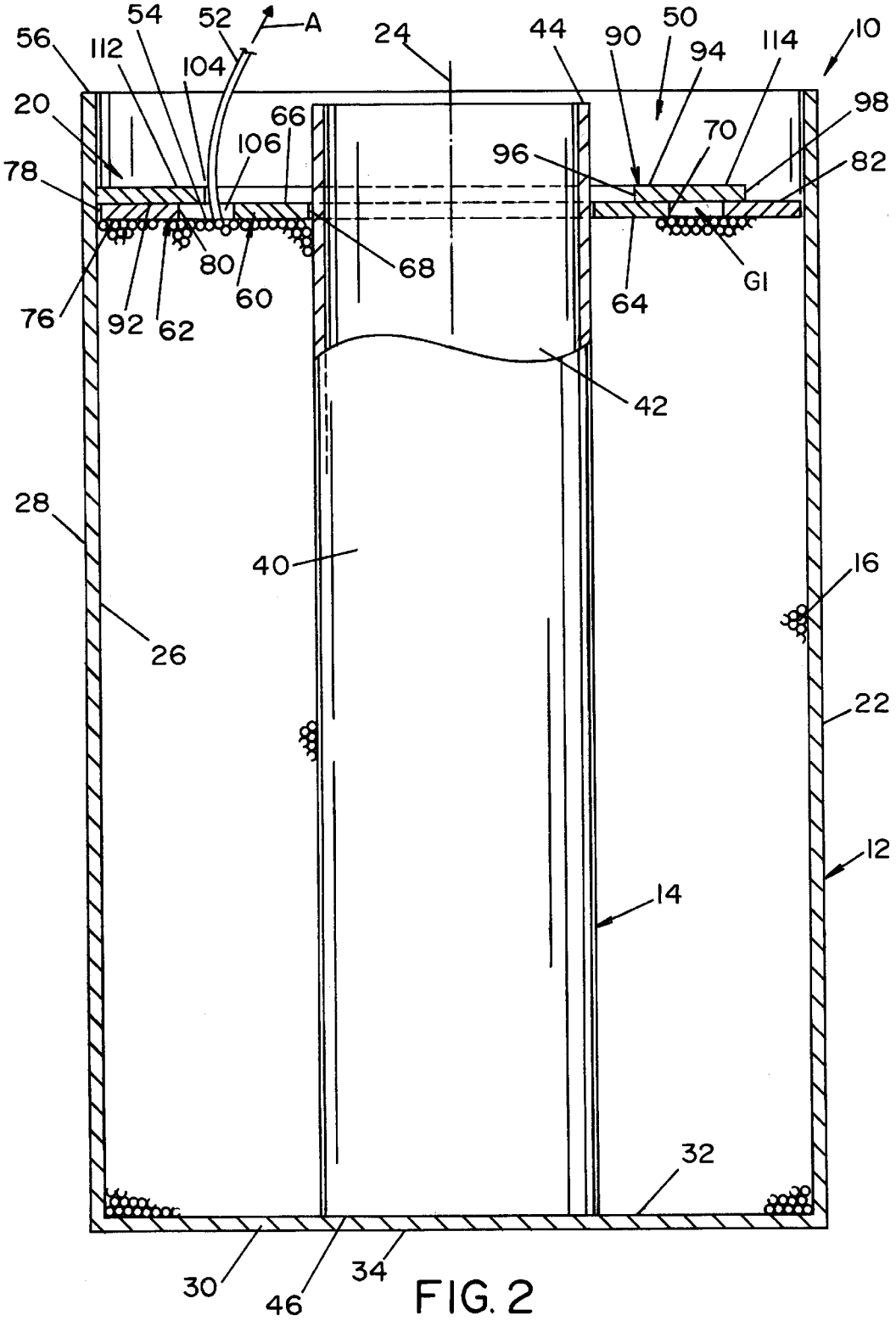
FIG. 2 is a sectional elevational view taken along line 2—2 in FIG. 1.
Figure 3:
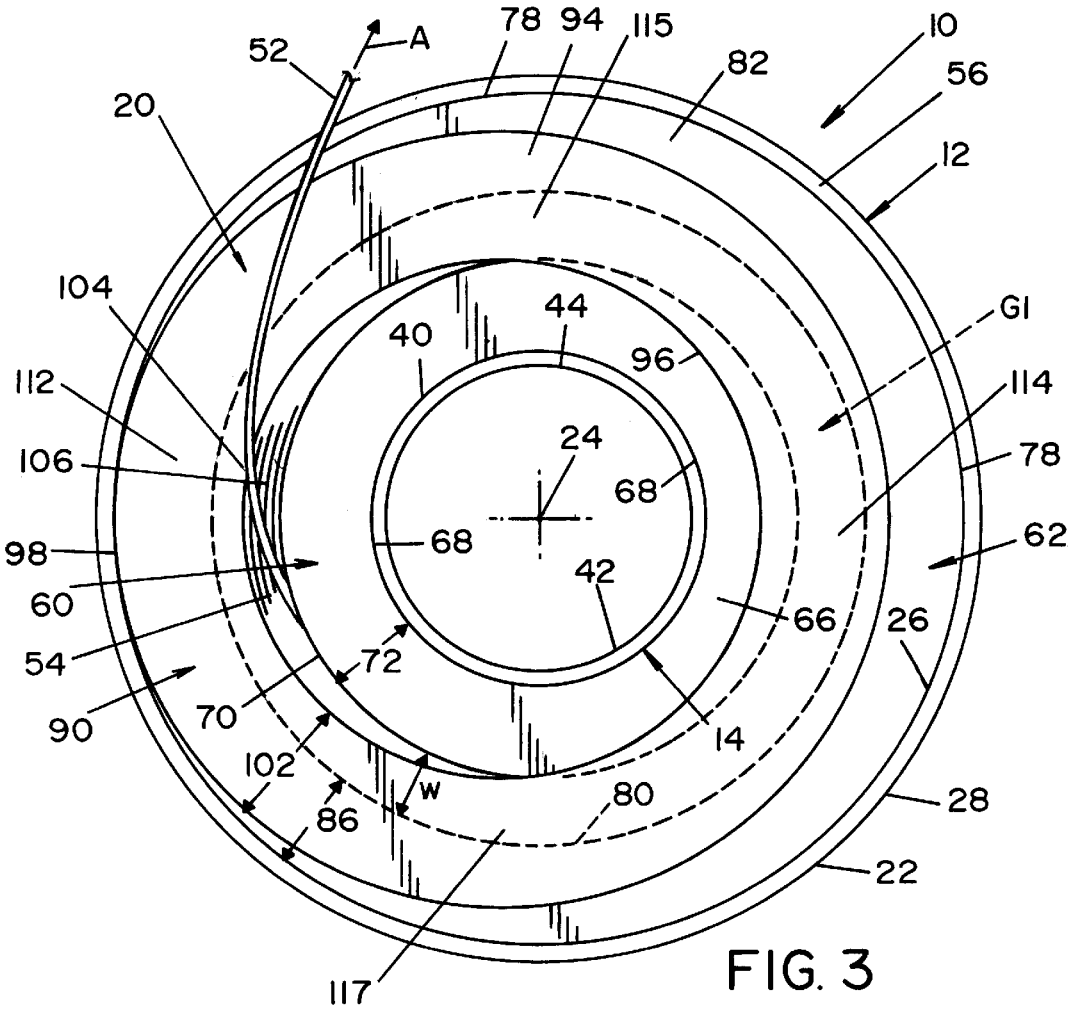
FIG. 3 is a top plan view of the welding wire package and payout shown in FIG. 1.
Figure 2A:
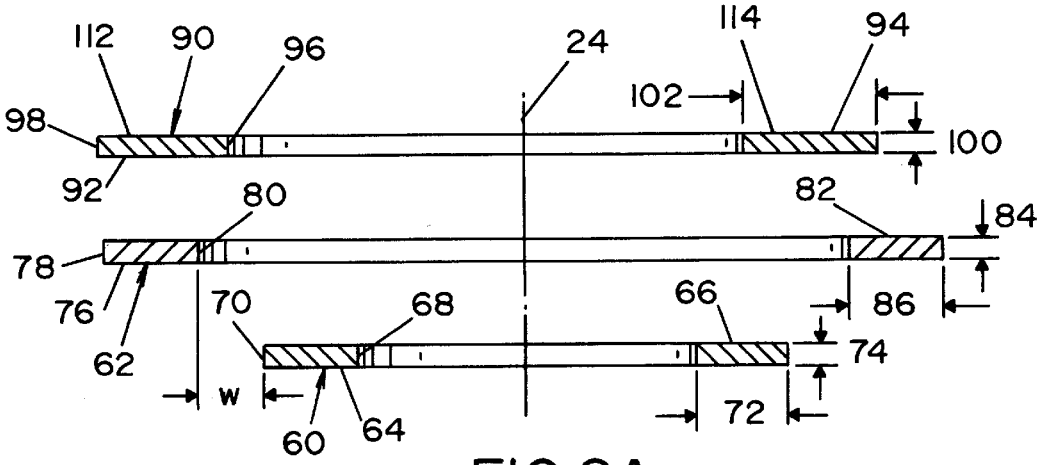
FIG. 2A is a detached exploded sectional view of the floating ring assembly.

Referring now in greater detail to the drawings wherein the showings are for the purpose of illustrating preferred embodiments of the invention only, and not for the purpose of limiting the invention, FIGS. 1–3 illustrate a welding wire package 10 which is shown as a welding wire drum and will be described hereinafter with relation to such a wire drum even though the invention of this application can be used in connection with other styles of welding wire packages. Welding wire package 10 includes a wire drum 12, an inner core 14, a coil of wire 16 and a payout 20. Wire drum 12 has a cylindrical outer drum body 22 which is coaxial with a drum axis 24 and which has an inwardly facing surface 26 and an outwardly facing surface 28. Wire drum 12 further includes a drum bottom 30 having an upwardly facing surface 32 and an outside surface 34. Wire drum 12 can be made from any well-known packaging material such as paper, plastic, wood or steel. However, it must be able to withstand the outward forces and the weight of the wire coil 16. Inner core 14 is also cylindrical and coaxial with drum axis 24 and therefore coaxial with outer drum body 22. Inner core 14 has a height which is preferably slightly less than the height of drum body 22. Core 14 comprises an outer surface 40 and an inner surface 42 and has a top and a bottom edge 44 and 46, respectively. Wire coil 16 is positioned within wire receiving opening 50 which is defined by the drum body surface 26, upwardly facing surface 32, and core surface 40. Wire coil 16 is made up of many convolutions of a single strand of wire 52 and is packaged in opening 50 by wrapping wire 52 around inner core 14 and between the latter and wire drum 12 starting at surface 32 and continuing until the top 54 of the wire coil is close to the top edge 56 of outer drum body 22.

Payout 20 includes an inner ring 60 and an outer ring 62 positioned on coil top 54. In this respect, inner ring 60 has a bottom 64 juxtaposed wire coil top 54 and an oppositely facing top 66 with an inner edge 68 adjacent to core surface 40 and an outer edge 70 radially spaced from and opposite to inner edge 68. Ring 60 has a substantially rectangular cross-sectional configuration with a radial width 72 and a axial thickness 74. Outer ring 62 has a bottom 76 juxtaposed wire coil top 54 such that bottom 76 is substantially coplanar to inner ring bottom 64. Outer ring 62 further includes an outer edge 78 adjacent to drum surface 26 and an oppositely facing inner edge 80. Inner edge 80 is spaced from inner ring outer edge 70, thereby forming a circumferentially extending radial gap G1 between inner and outer rings 60 and 62. Gap G1 is a continuous circular gap coaxial with drum axis 24 and which has a generally consistent width w about wire coil top 54. Outer ring 62 further includes a top 82 which is substantially coplanar with inner ring top 66. As with inner ring 60, outer ring 62 has a rectangular cross-sectional configuration with a thickness 84 and a width 86. Payout 20 further includes a floating ring 90 resting on and moving relative to inner and outer rings 60 and 62 during payout as will become more apparent hereinafter. Floating ring 90 includes a bottom 92 which rests on portions of inner ring top 66 and outer ring top 82. Floating ring 90 further includes a top 94 which is opposite to an spaced from bottom 92 and oppositely facing inner and outer edges 96 and 98, respectively. Therefore, floating ring 90 has a substantially rectangular cross-sectional configuration with a thickness 100 and a width 102. Inner ring 60, outer ring 62 and floating ring 90 can be made from many different types of material such as cardboard, press board, plastics, or metals. In addition, while the rings 60, 62, and 90 are shown with a rectangular cross-sectional configuration, other configurations could be used without departing from the invention.

Payout 20 controls the unwinding of wire 52 by the interaction between inner ring 60, outer ring 62 and floating ring 90. As stated above, there are two aspects of controlling the unwinding of wire 52 from a wire coil package 10 which include preventing the upward springing of the wire convolutions within the wire coil package 10 and managing wire 52 as it travels from package 10 to the wire feeder. Inner and outer rings 60 and 62 are stationary rings in that they essentially remain laterally stationary relative to one another and relative to drum body 22 as the rings descend into wire receiving opening 50. Inner and outer rings 60 and 62 are the primary factor in controlling the upward springing effect of the wire convolutions. Conversely, as will become more apparent hereinafter, during payout floating ring 90 continuously moves eccentrically relative to axis 24, relative to inner and outer rings 60 and 62, and relative to core 14 and drum body 22 as the wire is unwound from welding wire coil. Floating ring 90 is the primary factor in controlling wire 52 as it travels between payout 20 and the wire feeder at the welder by creating a slight tension in wire 52 and by guiding wire 52 as it is unwound from wire coil 16.

Rings 60 and 62 primarily control the upward springing effect of the wire convolutions by covering a majority of wire coil top 54 and minimizing the space between inner ring 60 and inner core 14 and outer ring 62 and drum body 22. Further, the weight of rings 60 and 62 and floating ring 90 apply a downward force to the wire coil top 54. The weight of floating ring 90 along with its coverage of a majority of gap G1 assists rings 60 and 62 in controlling the upward springing of wire 52. In this respect, floating ring 90 rests on top of rings 60 and 62 such that floating ring bottom 92 is juxtaposed inner and outer ring tops 66 and 82 respectively. Due to the shape and size of floating ring 90 relative to drum body 22, core 14 and rings 60 and 62, as wire 52 passes through gap G1, it moves in gap G1 about drum axis 24 and engages floating ring 90 about its inner edge 96 as shown in FIGS. 1 and 2, causing floating ring 90 to move, or float, relative to rings 60 and 62 and thus gap G1. More particularly in this respect, as will be appreciated from FIG. 1 and considering the positions of the parts therein to be an initial position, wire 52 engages inner edge 96 of ring 90 at engagement point 104 which urges ring 90 radially outwardly toward drum body 22 until outer edge 98 thereof engages drum surface 26. Width 102 of ring 90 is such that as outer edge 96 engages drum surface 26, inner edge 96 is positioned above gap G1 between outer ring inner edge 80 and inner ring outer edge 70. Furthermore, the diameters of outer edge 70 of ring 60 and inner edge 80 of ring 62 and the diameters of inner edge 96 and outer edge 98 of the floating ring, are such that the majority of gap G1 is covered by floating ring 90 and an opening 106 is formed at engagement point 104. Opening 106 is crescent shaped and, preferably, extends circumferential of gap G1 about one-half the circumference thereof. This provides a limited opening for wire 52 to pass through payout 20, thereby assisting in preventing upward springing by the convolutions of wire. Ring width 102 is greater than the width of gap G1 so that ring 90 remains on top of inner and outer rings 60 and 62 as it moves relative to rings 60 and 62. As will be appreciated from FIG. 1, as wire 52 is pulled from the package in the direction of arrow A, ring 90 is displaced eccentrically relative to axis 24 and opening 106 moves, progressively, clockwise about axis 24.

Floating ring 90 creates tension in wire 52 and guides wire 52 in two ways. First, as wire 52 is unwound from wire coil 16 it moves about axis 24 thereby moving floating ring 90 relative to rings 60 and 62 as described above. The frictional resistance of ring 90 as it moves relative to rings 60 and 62 creates tension in wire 52. Second, as wire 52 moves through gap G1 and opening 106, it engages floating ring edge 96 and one of edges 70 and 80 of rings 60 and 62, respectively, which creates tension in wire 52 and also guides the wire. Due to the floating ring width 102, and the diameters of inner and outer edges 96 and 98, wire 52 is constantly urging floating ring 90 outwardly at a differing point about axis 24. In this respect, as wire 52 urges floating ring 90 outward at engagement point 104, which is shown in FIGS. 1–3 as being at a first ring portion 112, second ring portion 114, which is opposite first ring portion 112, and third and fourth ring portions 115 and 117 which are between the first and second portions and opposite one another become positioned over gap G1. As wire 52 moves from first portion 112 toward second portion 114, engagement point 104 moves counter-clockwise about axis 24 toward ring portion 114 and, ultimately, portion 114 is urged outwardly toward drum surface 26 and first portion 112 is urged inwardly over gap G1. At this point, opening 106 is diametrically opposite the position thereof in FIGS. 1–3. This movement continues as wire 52 is unwound from wire coil 16 and causes the floating action of floating ring 90. As wire 52 passes through opening 106 it is directed by its engagement with the edges of the rings, and, as the engagement point 104 moves about drum axis 24, opening 106 moves relative to engagement point 104 about axis 24 in a similar fashion. Furthermore, by removing wire 52 through gap G1 and opening 106, a central removal point is achieved thereby reducing the stresses imparted on wire 52 as it is unwound from wire coil 16 and removed from package 10. These advantages are accomplished by utilizing rings 60, 62 and 90 which are simple in structure.

In order to maximize the effectiveness of the rings, the following functional relationships between the rings, which are generally shown in the drawings, can be utilized. In this respect, if floating ring width 102 is less than ½ the diameter of the outer ring inner edge 80 minus ½ the diameter of the inner core surface 40, opening 106 is formed as wire 52 urges second portion 114 of floating ring 90 inwardly against inner core surface 40. Furthermore, if the floating ring width 102 is greater than inner ring width 72, floating ring outer edge 98 is maintained over gap G1 as floating ring inner edge 96 engages core surface 40. In similar fashion, floating ring inner edge 96 will be generally centered over gap G1, relative to engagement point 104, if floating ring width 102 is generally equal to ¼ the diameter of inner ring outer edge 70 plus ¼ the diameter of outer ring inner edge 80 minus ½ the diameter of inner core surface 40. The portion of floating ring 90 at second portion 114 can fully cover gap G1, while engagement point 104 is at first portion 112, if the diameter of floating ring inner edge 96 is less than ½ the diameter of inner core surface 40 plus ½ the diameter of inner ring outer edge 70. In addition, floating ring width 102 must be greater than the width of gap G1. In similar fashion, the diameter of floating ring inner edge 96 is to be less than the diameter of inner core surface 40 plus inner ring width 72 for floating ring inner edge 96 to be maintained on inner ring top 66 at second portion 114 while engagement point 104 is at first portion 112. Furthermore, the diameter of floating ring outer edge 98 should be greater than the diameter of inner ring outer edge 70 plus the width of gap G1 in order for floating ring 90 to fully cover gap G1 at second portion 114 while engagement point 104 is at first portion 112. However, the diameter of floating ring outer edge 98 should be less than ½ the diameter of drum surface 26 plus ½ the diameter of outer ring inner edge 80 so that gap 106 can be formed at engagement point 104 as floating ring inner edge 96 engages inner core surface 40.

In the following discussions concerning other embodiments, the components of the welding wire package 10 which remain the same, as discussed above, will include the same reference numbers as above.

Figure 4:
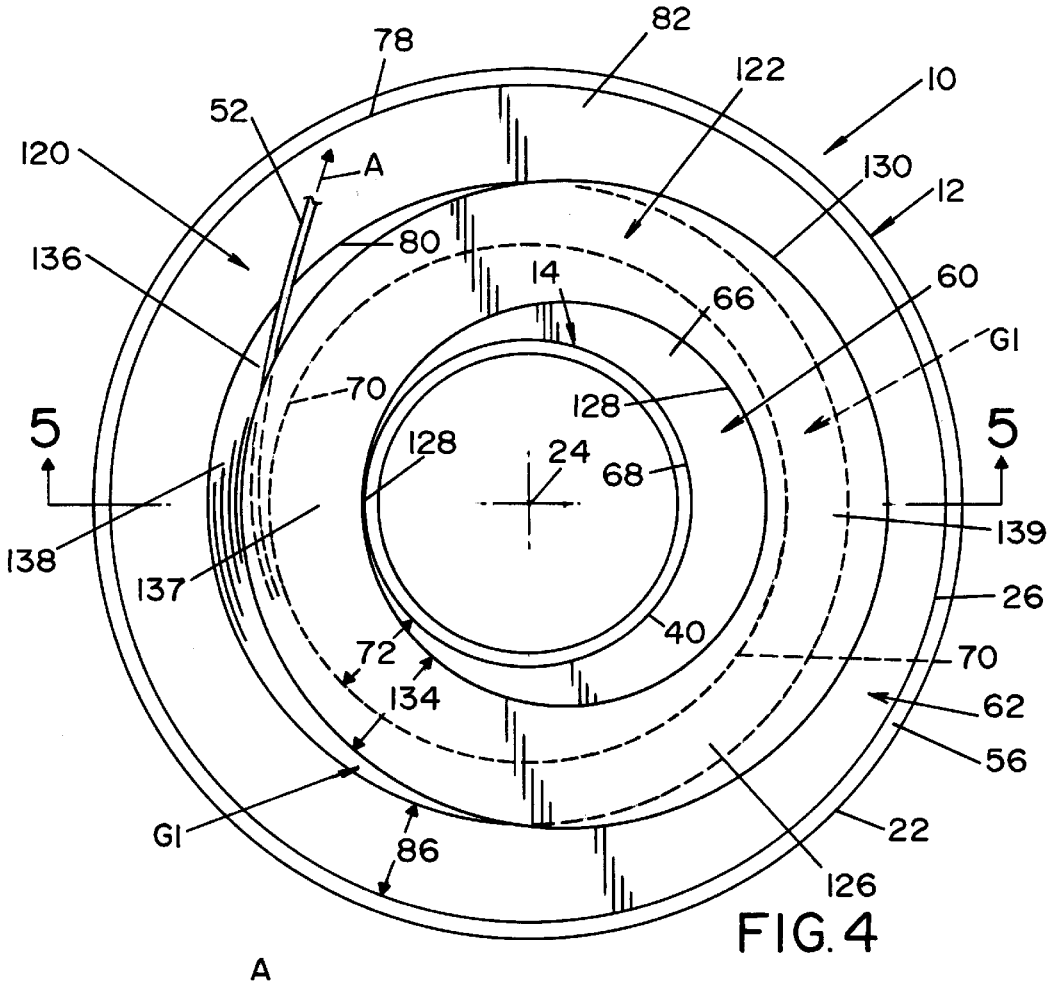
FIG. 4 is a top plan view of a welding wire package including another embodiment of a payout in accordance with the present invention.
Figure 5:
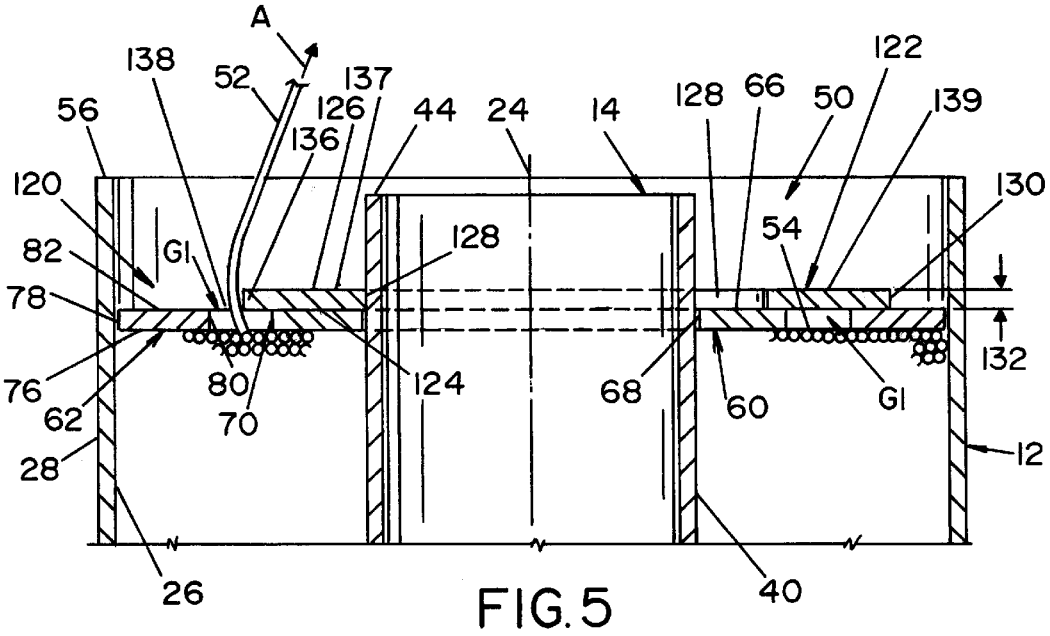
FIG. 5 is a sectional elevational view of the upper portion of the wire package taken along line 5—5 in FIG. 4.

Referring to FIGS. 4 and 5, a payout 120 is shown. Payout 120 includes inner and outer rings 60 and 62 which function as described above and further includes floating ring 122. Floating ring 122 is similar to floating ring 90 in that it includes a bottom 124 which rests on inner ring top 66 and outer ring top 82 and a top 126 which is opposite to and spaced from bottom 124. Floating ring 122 further includes an inner edge 128 and an oppositely facing outer edge 130. Furthermore, floating ring 122 has a substantially rectangular cross-sectional configuration with a thickness 132 and a width 134. However, floating ring 122 is a different size than floating ring 90 and therefore, wire 52 passes about floating ring outer edge 130 as it is unwound from wire coil 16 through gap G1. More particularly, wire 52 engages floating ring 122 at an engagement point 136 which urges ring portion 137 inwardly towards inner core 14. The width 134 of ring 122 is such that as the ring engages inner core surface 40, outer edge 130 thereof is positioned above and between outer edge 70 of ring 60 and inner edge 80 of ring 62, and over gap G1. Thus, outer edge 130 of ring 122 and inner edge 80 of ring 62 define a restricted opening 138 which like opening 106 is crescent shaped and extends about one-half the circumference of the gap G1. The diameters of inner edge 128 and outer edge 130, of ring 122 are such that the ring covers an increasing portion of gap G1 moving from ring portion 137 toward ring portion 139 when engagement point 136 is at ring portion 137. Accordingly, wire 52 can only pass through opening 138. As wire 52 is unwound form wire coil 16, the engagement point 136 and opening 138 move clockwise about the drum axis 24 toward ring portion 139 and back again toward ring portion 137 for each convolution of wire. Engagement of wire 52 with edge 130 of ring 122 results in the floating ring moving eccentrically relative to inner and outer rings 60 and 62 and axis 24. This creates tension in wire 52. Furthermore, during payout wire 52 engages floating ring edge 130 along with one or the other of inner ring edge 70 and outer ring edge 80 thereby further controlling the payout the of wire.

Referring to FIGS. 4 and 5, a payout 120 is shown. Payout 120 includes inner and outer rings 60 and 62 which function as described above and further includes floating ring 122. Floating ring 122 is similar to floating ring 90 in that it includes a bottom 124 which rests on inner ring top 66 and outer ring top 82 and a top 126 which is opposite to and spaced from bottom 124. Floating ring 122 further includes an inner edge 128 and an oppositely facing outer edge 130. Furthermore, floating ring 122 has a substantially rectangular cross-sectional configuration with a thickness 132 and a width 134. However, floating ring 122 is a different size than floating ring 90 and therefore, wire 52 passes about floating ring outer edge 130 as it is unwound from wire coil 16 through gap G1. More particularly, wire 52 engages floating ring 122 at an engagement point 136 which urges ring portion 137 inwardly towards inner core 14. The width 134 of ring 122 is such that as the ring engages inner core surface 40, outer edge 130 thereof is positioned above and between outer edge 70 of ring 60 and inner edge 80 of ring 62, and over gap G1. Thus, outer edge 130 of ring 122 and inner edge 80 of ring 62 define a restricted opening 138 which like opening 106 is crescent shaped and extends about one-half the circumference of the gap G1. The diameters of inner edge 128 and outer edge 130, of ring 122 are such that the ring covers an increasing portion of gap G1 moving from ring portion 137 toward ring portion 139 when engagement point 136 is at ring portion 137. Accordingly, wire 52 can only pass through opening 138. As wire 52 is unwound form wire coil 16, the engagement point 136 and opening 138 move counterclockwise about the drum axis 24 toward ring portion 139 and back again toward ring portion 137 for each convolution of wire. Engagement of wire 52 with edge 130 of ring 122 results in the floating ring moving eccentrically relative to inner and outer rings 60 and 62 and axis 24. This creates tension in wire 52. Furthermore, during payout wire 52 engages floating ring edge 130 along with one or the other of inner ring edge 70 and inner ring edge 80 thereby further controlling the payout the of wire.

Figure 8:
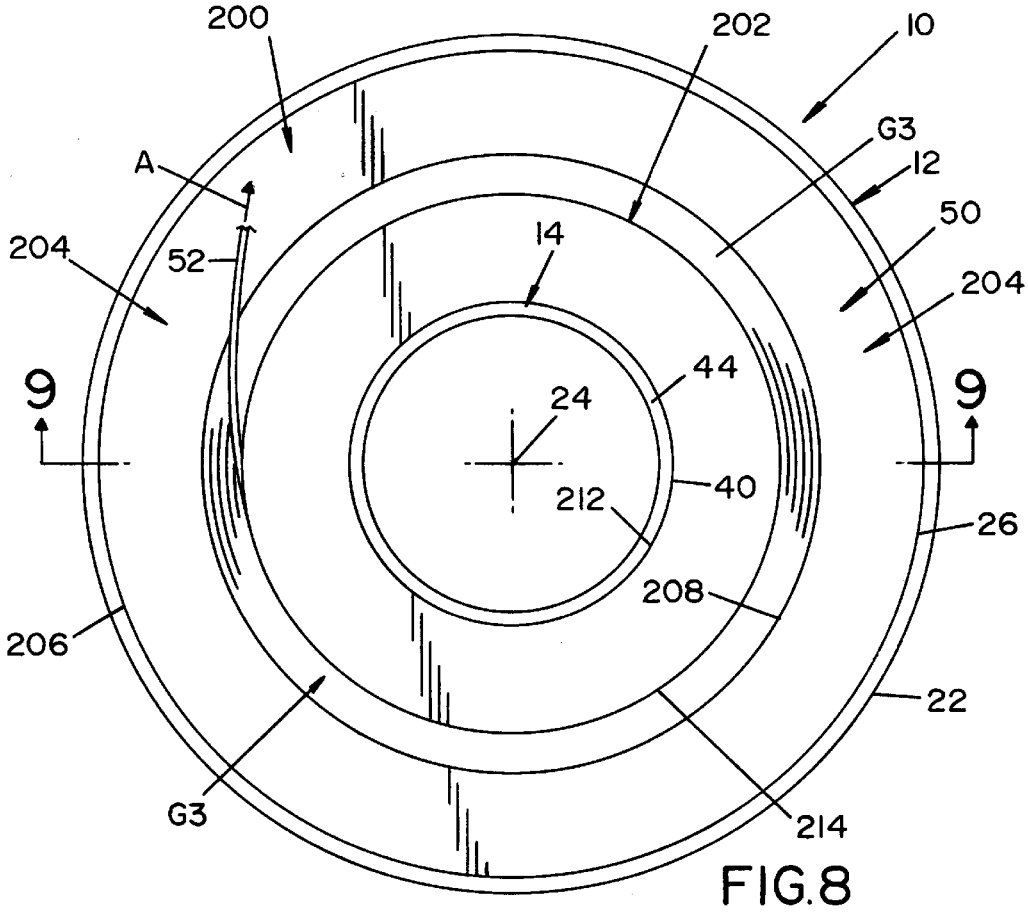
FIG. 8 is a top plan view of a welding wire package including still another embodiment of a payout in accordance with the present invention.
Figure 9:
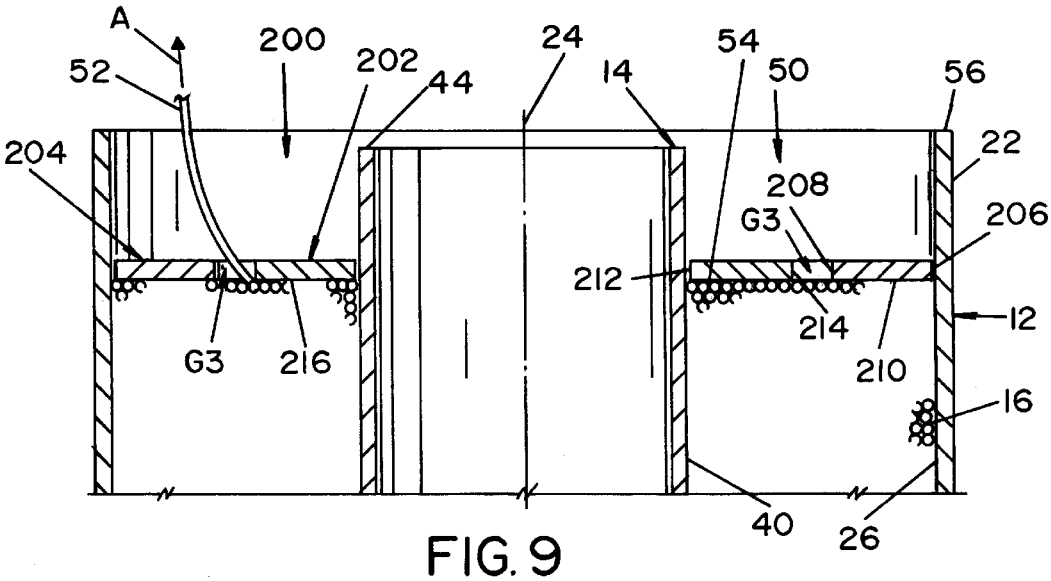
FIG. 9 is a sectional elevational view of the upper portion of the package taken along line 9—9 in FIG. 8.

Referring to FIGS. 8 and 9, a payout 200 is shown which includes an inner ring 202 and an outer ring 204. Payout 200 advantageously allows wire 52 to be unwound from wire coil 16 along a circumferential path which is radially central with respect to wire receiving opening 50. Inner and outer rings 202 and 204 are both stationary, laterally, and outer ring 204 has an outer edge 206 adjacent to drum surface 26 and inner ring 202 has an inner edge 212 adjacent to core surface 40. This prevents the convolutions of wire from springing upwardly about the outside or the inside of payout 200. As stated above, the upwardly springing effect of the convolutions primarily takes place at the outermost regions of the container, namely, at places near drum surface 26. However, by also including inner ring 202, payout is from a central portion of wire coil 16 and the upward springing is further controlled. As with the embodiments discussed above, outer ring 204 further includes an inner edge 208 which is spaced from and opposite to outer edge 206, and a bottom 210 juxtaposed wire coil top 54. Inner ring 202 further includes an outwardly facing outer edge 214 which is spaced from outer ring edge 208, thereby forming gap G3. Inner ring 202 further includes bottom surface 216 juxtaposed wire coil top 54 and generally coplanar with outer ring bottom 210. Gap G3 is a continuous, generally circular gap about drum axis 24 and is generally centered within wire receiving opening 50 about drum axis 24. Accordingly, as wire 52 is unwound from wire coil 16, it passes through gap G3 about drum axis 24 and the engagement with inner ring 202 and/or outer ring 204 and edges 208 and 214 thereof helps control the unwinding of wire 52 from wire coil 16 and prevents the upwardly springing of the wire convolutions.

Figure 10:
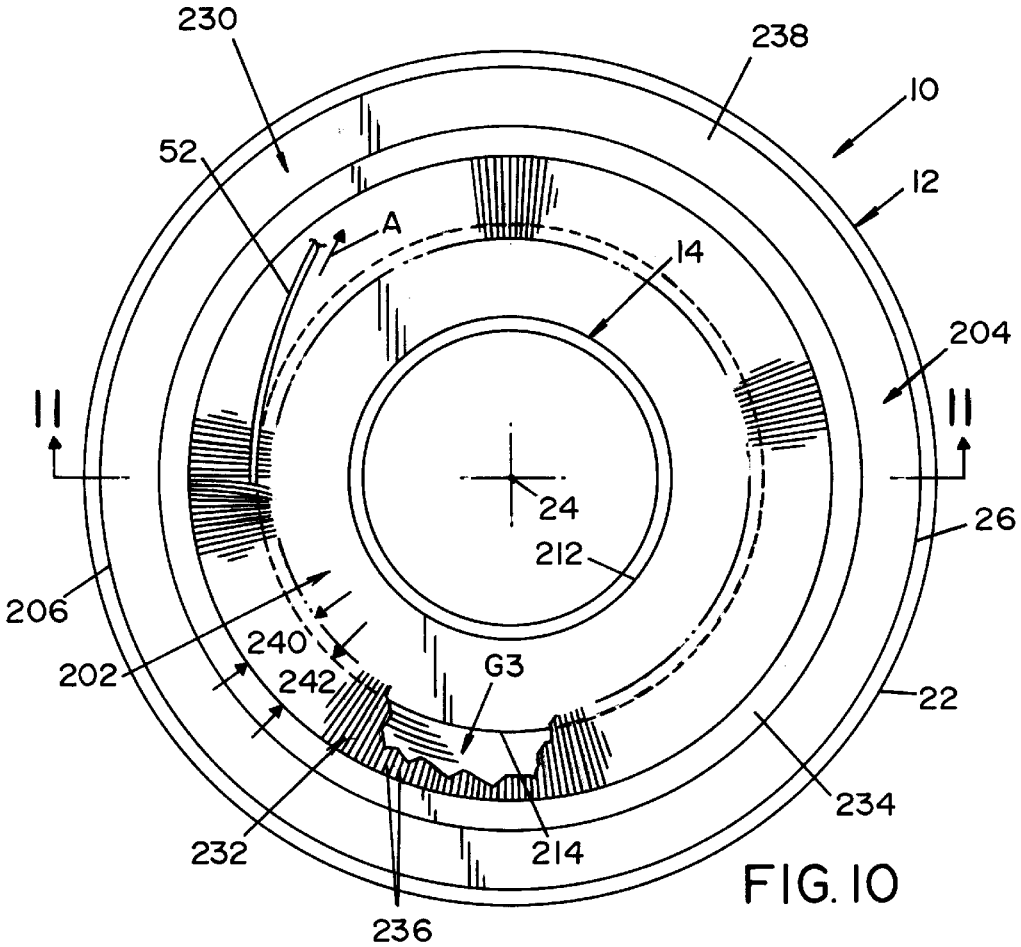
FIG. 10 is a top plan view of a welding wire package including another embodiment of a payout in accordance with the present invention.
Figure 11:
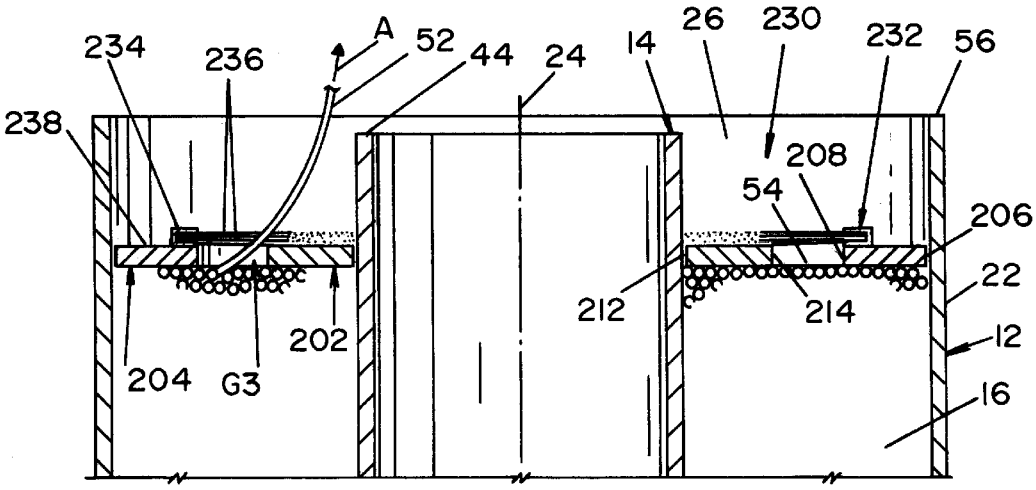
FIG. 11 is a sectional elevational view of the upper portion of the package taken along line 11—11 in FIG. 10.

Referring to FIGS. 10 and 11, shown is a payout 230 which includes inner and outer rings 202 and 204, respectively, as shown in FIGS. 8 and 9, and further includes a brush ring 232. Brush ring 232 creates tension in wire 52 by the frictional engagement between wire 52 and the many brush fibers or bristles 236 attached to the ring. Brush ring 232 is a stationary ring and is attached to top surface 238 of outer ring 204 such that brush fibers 236 extend radially inwardly toward inner ring 202 and cover gap G3. Brush fibers 236 have lengths 240 which are greater than the width 242 of gap G3 and, therefore, fibers 236 extend from brush retainer ring 234 over gap G3 to a point over and inwardly of edge 214 of inner ring 202. Since fibers 236 are retained at one of their ends by retainer 234, the fibers deflect upwardly against the natural resiliency thereof to allow wire 52 to move about drum axis 24 in gap G3 as it is unwound from wire coil 16 while imposing a force on the wire which tensions the latter. In addition, wire 52 engages inner ring edge 214 and/or outer ring edge 208 which further tensions and guide the wire out of package 10. While brush fibers are preferred, it will be appreciated that a thin film of latex or the like would provide the desired resiliency to control the payout and tension the wire.

While considerable emphasis has been placed on the preferred embodiments of the invention illustrated and described herein, it will be appreciated that other embodiments can be made and that many changes can be made in the preferred embodiments without departing from the principles of the invention. Accordingly, it is to be distinctly understood that the foregoing descriptive matter is to be interpreted merely as illustrative of the invention and not as a limitation.

Having thus described the invention, it is claimed:

1. A payout device for controlling the payout of wire from a coil of wire in a drum having a drum axis and a drum body and a core coaxial with said axis, said coil of wire being wound about said core and having a top, said payout comprising: a first ring resting on the top of the wire coil and having a first inner edge adjacent to the core and a first outer edge spaced from said first inner edge, a second ring resting on the top of the wire coil and having a second outer edge adjacent to the drum body, and a second inner edge spaced from said second outer edge, said first outer edge being spaced from said second inner edge to define a continuous generally circular gap above the top of the wire coil such that the wire passes upwardly through said gap as it is payed out from the wire coil, a third ring having a third inner edge and a third outer edge spaced from said third inner edge; said third ring overlying said first and second rings and at least partially covering said gap, and the wire being withdrawn through said gap displaces said third ring relative to said first and second rings and eccentrically relative to said axis.

2. The payout as defined in claim 1, wherein said gap has a radial width and said third ring has a radial width defined by the distance between said third inner edge and said third outer edge, said width of said third ring being greater than the width of said gap.

3. The payout as defined in claim 2, wherein said first ring has a width defined by the distance between said first inner edge and said first outer edge, said width of said third ring being greater than said width of said first ring.

4. The payout as defined in claim 1, wherein said first ring has a width defined by the distance between said first inner edge and said first outer edge and said third ring has a width defined by the distance between said third inner edge and said third outer edge, said width of said third ring being greater than said width of said first ring.

5. The payout as defined in claim 1, wherein said first, second and third rings are annular rings, respectively having first, second and third inner diameters and first, second and third outer diameters, the core being cylindrical and having a core diameter, and the drum body being cylindrical and having a drum diameter.

6. The payout as defined in claim 5, wherein said third ring has a width defined by the distance between said third inner edge and said third outer edge; said width being less than ½ the second inner diameter minus ½ said core diameter.

7. The payout as defined in claim 6, wherein said gap has a width, and said width of said third ring is greater than the width of said gap.

8. The payout as defined in claim 7, wherein said first ring has a width defined by the distance between said first inner edge and said first outer edge, and said width of said third ring is greater than said width of said first ring.

9. The payout as defined in claim 6, wherein said first ring has a width defined by the distance between said first inner edge and said first outer edge, and said width of said third ring is greater than said width of said first ring.

10. The payout as defined in claim 6, wherein said width of said third ring is generally equal to ¼ the first outer diameter plus ¼ the second inner diameter minus ½ the core diameter.

11. The payout as defined in claim 5, wherein said gap has a width equal to ½ the second inner diameter minus ½ the first outer diameter.

12. The payout as defined in claim 5, wherein the third inner diameter is less than ½ the core diameter plus ½ the first outer diameter.

13. The payout as defined in claim 12, wherein said gap has a width and said third ring has a width defined by the distance between said third inner edge and said third outer edge, said width of said third ring being greater than the width of said gap.

14. The payout as defined in claim 13, wherein said first ring has a width defined by the distance between said first inner edge and said first outer edge, and said width of said third ring is greater than said width of said first ring.

15. The payout as defined in claim 12, wherein said first ring has a width defined by the distance between said first inner edge, and said first outer edge and said third ring has a width defined by the distance between said third inner edge and said third outer edge; said width of said third ring being greater than said width of said first ring.

16. The payout as defined in claim 5, wherein said first ring has a width defined by the distance between said first inner edge and said first outer edge, the third inner diameter being less than said core diameter plus said width of said first ring.

17. The payout as defined in claim 16, wherein said gap has a width, said third ring has a width defined by the distance between said third inner edge and said third outer edges, and said width of said third ring is greater than the width of said gap.

18. The payout as defined in claim 17, wherein said width of said third ring is greater than said width of said first ring.

19. The payout as defined in claim 16, wherein said third ring has a width defined by the distance between said third inner edge and said third outer edge, said width of said third ring being greater than said width of said first ring.

20. The payout as defined in claim 5, wherein said gap has a width and the third outer diameter is greater than said first outer diameter plus, the width of said gap.

21. The payout as defined in claim 5, wherein the third outer diameter is greater than ¾ the second inner diameter plus ¼ the first outer diameter.

22. The payout as defined in claim 5, wherein the third outer diameter is less than ½ said drum diameter plus ½ the second inner diameter.

23. The payout as defined in claim 22, wherein said gap has a width and the third outer diameter is greater than the first outer diameter plus the width of said gap.

24. The payout as defined in claim 23, wherein said first ring has a width defined by the distance between said first inner edge and said first outer edge, the third inner diameter being less than said core diameter plus said width of said first ring.

25. A payout device for controlling the payout of wire from a coil of wire in a drum having a drum axis and a drum body and a core coaxial with said axis, said coil of wire being wound about said core and having a top, said payout comprising: a first ring resting on the top of the wire coil and having a first inner edge adjacent to the core and a first outer edge spaced from said first inner edge, a second ring resting on the top of the wire coil and having a second outer edge adjacent to the drum body, and a second inner edge spaced from said second outer edge, said first outer edge being spaced from said second inner edge to define a continuous generally circular gap above the top of the wire coil such that the wire passes upwardly through said gap as it is payed out from the wire coil, a third ring having a third inner edge and a third outer edge spaced from said third inner edge; said third ring overlying said first and second rings and at least partially covering said gap, and said third ring partially covers said gap to provide an opening defined by one of the inner edge of said third ring and the outer edge of the first ring and the inner edge of said second ring and the outer edge of said third ring.

26. The payout as defined in claim 25, wherein said opening is crescent shaped circumferentially of said gap.

27. The payout as defined in claim 26, wherein said opening extend circumferentially about ½ the circumference of said gap.

28. A payout for controlling the unwinding of a coil of wire from a wire drum including an outer drum body having a drum axis and an inner core coaxial with the drum body, the coil of wire being received in an annular passage between the drum body and the of the inner core and having a top end, said passage having a radial width defined by the distance between the inner core surface and the outer drum, said payout comprising: a first substantially planar ring juxtaposed to the top end of the wire coil and having a first inner edge facing said core and a first outer edge adjacent said drum body, said first ring having a width between said first inner and said first outer edges less than the width of said annular passage thereby defining a continuous circular gap about said axis between said first inner edge and said core, said gap being above the wire coil such that the wire passes upwardly through said gap as it is payed out from the wire coil, a second substantially planar ring having a second inner edge and a second outer edge, said second ring overlying said first ring and partially covering said gap, said first ring being laterally stationary, and said second ring being laterally displacable relative to said first ring and eccentrically relative to said axis as the wire is payed from said drum.

29. A payout for controlling the payout of wire from a coil of wire in a drum having a drum axis and a drum body and a core coaxial with said axis, said coil of wire being wound about said core and having a top, said payout comprising: plurality of rings overlying the top of the wire coil between said drum body and said core, a first ring of said plurality being laterally stationary relative to said axis and having a first outer edge adjacent to the drum body and a first inner edge spaced from said first outer edge and from said core, a second ring of said plurality which moves in connection with one of said first ring, another ring of said plurality and said core to further define a payout opening extending about said axis at a location between said radially inner edge of said first ring and said core said second ring is coplanar with said first ring and, laterally stationary with respect to said axis, said second ring having a second inner edge adjacent said core and a second outer edge spaced inwardly from said first inner edge to define a gap therebetween extending about said axis and a third ring overlying said first and second rings and being laterally displacable relative to said axis to partially cover said gap.

30. The payout as defined in claim 29, wherein said drum body has a drum diameter, said third ring has a third inner edge and a third outer edge, said third outer edge having a diameter less than said drum diameter, said second outer edge having a diameter, and said third inner edge having a diameter greater than the diameter of said second outer edge.

31. The payout as defined in claim 29, wherein said core has a core diameter, said third ring has a third inner edge and a third outer edge, said third inner edge having a diameter greater than said core diameter, said first inner edge having a diameter, and said third outer edge having a diameter less than the diameter of said first inner edge.

* * * * *

UNITED STATES PATENT AND TRADEMARK OFFICE

CERTIFICATE OF CORRECTION

PATENT NO. : 6,745,899 B1
APPLICATION NO. : 10/083426
DATED : June 8, 2004
INVENTOR(S) : David J. Barton It is certified that error appears in the above-identified patent and that said Letters Patent is hereby corrected as shown below:

Column 8, lines 5-42, delete:

"Referring to FIGS. 4 and 5, a payout 120 is shown. Payout 120 includes inner and outer rings 60 and 62 which function as described above and further includes floating ring 122. Floating ring 122 is similar to floating ring 90 in that it includes a bottom 124 which rests on inner ring top 66 and outer ring top 82 and a top 126 which is opposite to and spaced from bottom 124. Floating ring 122 further includes an inner edge 128 and an oppositely facing outer edge 130. Furthermore, floating ring 122 has a substantially rectangular cross-sectional configuration with a thickness 132 and a width 134. However, floating ring 122 is a different size than floating ring 90 and therefore, wire 52 passes about floating ring outer edge 130 as it is unwound from wire coil 16 through gap G1. More particularly, wire 52 engages floating ring 122 at an engagement point 136 which urges ring portion 137 inwardly towards inner core 14. The width 134 of ring 122 is such that as the ring engages inner core surface 40, outer edge 130 thereof is positioned above and between outer edge 70 of ring 60 and inner edge 80 of ring 62, and over gap G1. Thus, outer edge 130 of ring 122 and inner edge 80 of ring 62 define a restricted opening 138 which like opening 106 is crescent shaped and extends about one-half the circumference of the gap G1. The diameters of inner edge 128 and outer edge 130, of ring 122 are such that the ring covers an increasing portion of gap G1 moving from ring portion 137 toward ring portion 139 when engagement point 136 is at ring portion 137. Accordingly, wire 52 can only pass through opening 138. As wire 52 is unwound form wire coil 16, the engagement point 136 and opening 138 move clockwise about the drum axis 24 toward ring portion 139 and back again toward ring portion 137 for each convolution of wire. Engagement of wire 52 with edge 130 of ring 122 results in the floating ring moving eccentrically relative to inner and outer rings 60 and 62 and axis 24. This creates tension in wire 52. Furthermore, during payout wire 52 engages floating ring edge 130 along with one or the other of inner ring edge 70 and outer ring edge 80 thereby further controlling the payout the of wire."

Figure 6:
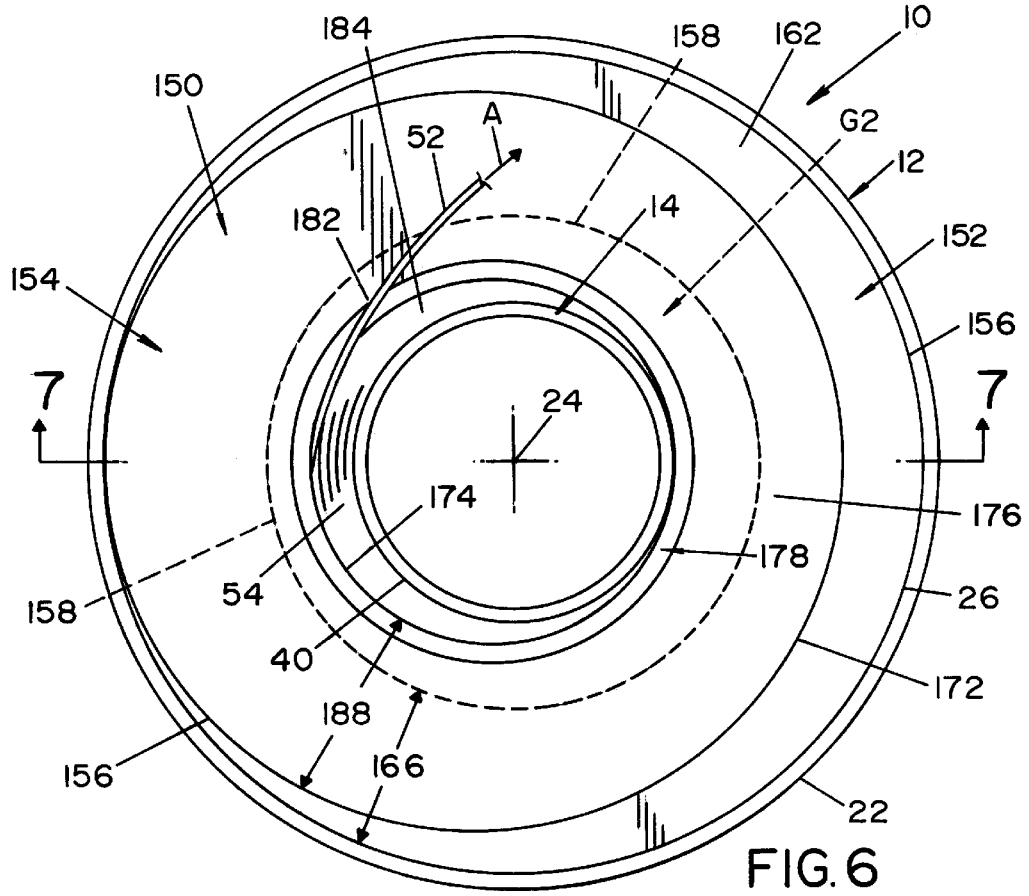
FIG. 6 is a top plan view of a welding wire package including yet another embodiment of a payout in accordance with the present invention.
Figure 7:
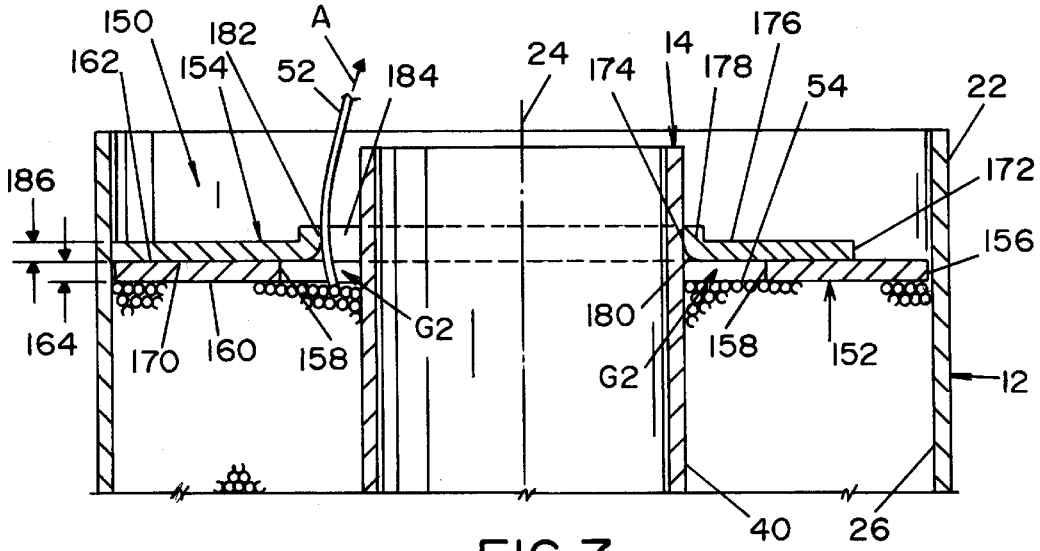
FIG. 7 is a sectional elevational view of the upper portion of the package taken along line 7—7 in FIG. 6.

Column 9, between lines 13 and 14, insert:

--Referring to FIGS. 6 and 7, a payout 150 is shown which includes a single stationary ring 152 and a floating ring 154. Since upward springing of the convolutions is most prevalent at the outer portions of wire coil top 54, near drum body 22, stationary ring 152 is positioned adjacent to drum surface 26. In this respect, stationary ring 152 has an outer edge 156 adjacent to drum surface 26 and an oppositely facing inner edge 158 spaced from inner core surface 40, thereby producing gap G2 therebetween. Ring 152 further includes a bottom 160 juxtaposed wire coil top 54 and an oppositely facing top 162. Ring 152 is laterally stationary relative to drum body 22 and essentially moves

UNITED STATES PATENT AND TRADEMARK OFFICE

CERTIFICATE OF CORRECTION

PATENT NO. : 6,745,899 B1
APPLICATION NO. : 10/083426
DATED : June 8, 2004
INVENTOR(S) : David J. Barton It is certified that error appears in the above-identified patent and that said Letters Patent is hereby corrected as shown below:

vertically only, not horizontally. Stationary ring 152 has a rectangular cross-sectional configuration having a thickness 164 and a width 166. Since only one stationary ring is utilized, ring width 166 is greater than that of the rings discussed in previous embodiments. Floating ring 154 has a bottom 170 which rests on ring top 162 and further includes an outer edge 172, an inner edge 174 and a top 176. Inner edge 174 includes an upwardly curved portion 178 having a rounded shoulder 180. Shoulder 180 reduces the chances of wire 52 being scarred or distorted by its engagement with floating ring 154. As with the embodiments discussed above, wire 52 passes through gap G2 and an opening 184 between core 14 and inner edge 174 and moves about drum axis 24 as it is unwound from wire coil 16. Wire 52 engages floating ring 154 at engagement point 182 which moves about ring edge 174 as wire 52 is unwound. The engagement between wire 52 and ring edge 174 causes the floating ring to move outwardly to the left in FIGS. 6 and 7 until it engages drum surface 26 thus forming the opening 184 which in this embodiment is crescent shaped and extends about three-quarters the circumference of gap G2. Floating ring 154 has a thickness 186 and a width 188. Width 188 is such that when floating ring 154 is urged outwardly by wire 52 to engage drum surface 26, inner edge 174 of the ring is positioned inwardly of stationary ring edge 158 and spaced from inner core surface 40 and above and generally centrally of gap G2. Furthermore, ring width 188 is greater than the width of gap G2 so that the dimensions of opening 184 are minimized.--

Signed and Sealed this

Seventh Day of July, 2009

John Doll

JOHN DOLL
*Acting Director of the United States Patent and Trademark Office*

US006745899C1

(12) INTER PARTES REEXAMINATION CERTIFICATE (780th)

United States Patent
Barton

(10) Number: US 6,745,899 C1
(45) Certificate Issued: Dec. 30, 2013

(54) WIRE PAYOUT

(75) Inventor: David J. Barton, Twinsburg, OH (US)

(73) Assignee: Lincoln Global Inc., Monterey Park, CA (US)

Reexamination Request:
No. 95/000,627, Apr. 11, 2011

Reexamination Certificate for:

| | |
|---|---|
| Patent No.: | **6,745,899** |
| Issued: | **Jun. 8, 2004** |
| Appl. No.: | **10/083,426** |
| Filed: | **Feb. 25, 2002** |

Certificate of Correction issued Jul. 7, 2009

(51) Int. Cl.

| | |
|---|---|
| ***B65D 85/67*** | (2006.01) |
| ***B65H 18/28*** | (2006.01) |
| ***B65H 49/00*** | (2006.01) |

(52) U.S. Cl.
USPC ..... 206/409; 206/408; 242/129; 242/171; 242/172

(58) Field of Classification Search
USPC ..... 206/408, 409; 242/129, 171, 172
See application file for complete search history.

(56) References Cited

To view the complete listing of prior art documents cited during the proceeding for Reexamination Control Number 95/000,627, please refer to the USPTO's public Patent Application Information Retrieval (PAIR) system under the Display References tab.

*Primary Examiner* — Jimmy G. Foster

(57) ABSTRACT

A payout for controlling the unwinding of a coil of wire from a wire drum which has an outer drum body and an inner core substantially coaxial with the drum body includes a first planar ring juxtaposed to the top of the wire coil and having a first inner edge closely adjacent to the core and a first outer edge spaced from the first inner edge and a second planar ring juxtaposed the top of the wire coil and having a second outer surface closely adjacent the drum body and a second inner surface spaced from the first outer surface of the first ring to define a continuous circular gap above the wire coil such that the wire passes upwardly through the gap as it is withdrawn from the wire coil. A third ring overlies the first and second rings and is laterally displacable relative thereto and eccentrically relative to the drum axis to further control payout of the wire. The second and third rings alone can be used to control payout of the wire.

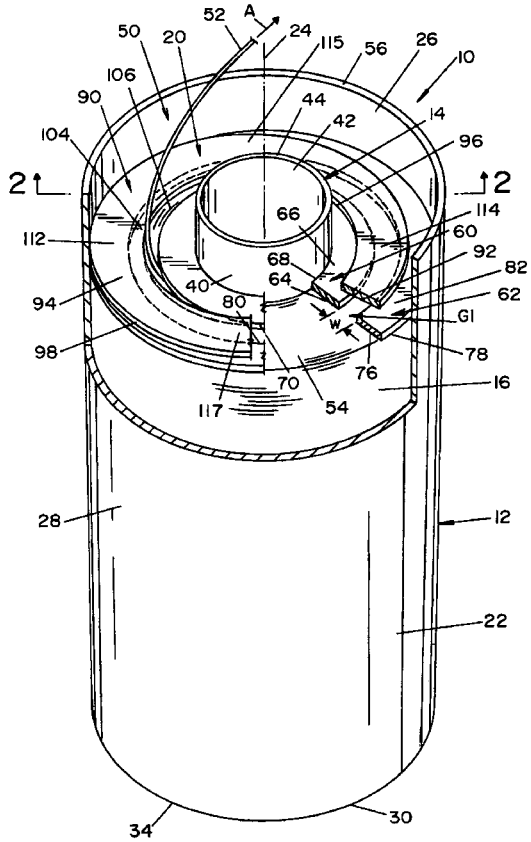

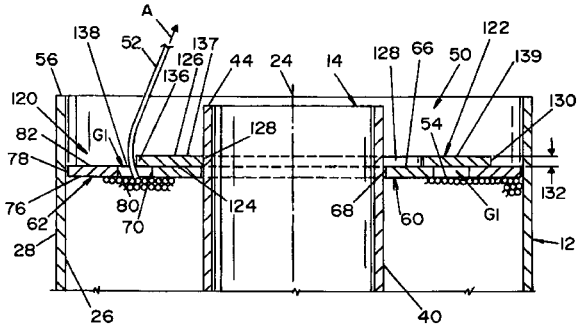

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claim 28 is confirmed.

Claims 1-27 and 29-31 were not reexamined.

* * * * *